United States Patent [19]

Tanuma et al.

[11] Patent Number: 5,071,268

[45] Date of Patent: Dec. 10, 1991

[54] WIRE-DOT PRINT HEAD DRIVING APPARATUS HAVING SENSING COILS

[75] Inventors: Jiro Tanuma; Hiroshi Sakaino; Hideaki Ishimizu; Chihiro Komori; Tadashi Kasai, all of Tokyo, Japan

[73] Assignee: Oki Electric Industry Co., Ltd., Tokyo, Japan

[21] Appl. No.: 431,172

[22] Filed: Oct. 26, 1989

[30] Foreign Application Priority Data

Oct. 28, 1988 [JP] Japan ..... 63-139931[U]
Sep. 29, 1989 [JP] Japan ..... 1-253840

[51] Int. Cl.[5] ..... B41J 9/44

[52] U.S. Cl. ..... 400/124; 400/157.3; 400/166

[58] Field of Search ..... 400/157.2, 124, 157.3, 400/166, 167; 101/93.02, 93.03, 93.29; 361/152, 153, 159

[56] References Cited

U.S. PATENT DOCUMENTS 4,273,039 6/1981 Luo et al. ..... 400/124
4,293,888 10/1981 McCarty ..... 400/166
4,396,304 8/1983 Daueport et al. ..... 400/157.2 X
4,433,927 2/1984 Cauallari ..... 400/124
4,735,517 4/1988 Knox, Jr. et al. ..... 400/157.2
4,812,062 3/1989 Ishinaga ..... 400/157.2
4,950,092 8/1990 Kikuchi et al. ..... 101/93.05 X

FOREIGN PATENT DOCUMENTS 0113567 5/1987 Japan ..... 400/157.2
62-233261 10/1987 Japan .
63-147669 6/1988 Japan .

*Primary Examiner*—Edgar S. Burr
*Assistant Examiner*—John S. Hilten
*Attorney, Agent, or Firm*—Spencer & Frank

[57] ABSTRACT

In a driving apparatus for a wire-dot print head having electromagnets for driving print wires, each electromagnet comprising a core and a coil, sensing coils are provided in association with the respective electromagnets and provided to interlink the magnetic flux passing through the core of the associated electromagnet, a magnetic flux detecting circuit is connected to the sensing coils for detecting the magnetic flux passing through the core, and a control and drive circuit is responsive to the detected magnetic flux for deciding the termination of the energization of the drive coil.

14 Claims, 8 Drawing Sheets

TA1
TA2
TB
CS
DS
53 FLIP-FLOP
D
Q
NQ
CK CLK
54
58 AND GATE
5V
WS1
WS2
52
52 OR GATE
51 COMPARATOR
47
Vref
55 NOT GATE
1KΩ 1KΩ
10KΩ
56 ONE-SHOT MULTIVIBRATOR
C C/R
57 OR GATE
60 REFERENCE VOLTAGE GENERATING CIRCUIT
61
62
63
64

WIRE-DOT PRINT HEAD DRIVING APPARATUS HAVING SENSING COILS

BACKGROUND OF THE INVENTION

This invention relates to an apparatus for driving a wire-dot print head in a wire-dot impact printer.

A wire-dot print head comprises a plurality of print wires, and a means for driving the print wires forward so that their ends impact on a sheet of paper. An inked ribbon is interposed between the ends of the print wires and the paper so that the impact of each wire causes the printing of a dot. Characters and graphic designs are printed as a matrix of dots by driving the print wires at appropriate times as the head travels across the paper.

In the well-known spring-release type of wire-dot print head, the means for driving each print wire comprises an armature, a plate spring, and an electromagnet. The plate spring is secured at one end. The print wire is attached to the armature, which is mounted on the free end of the plate spring.

Normally a permanent magnet holds the spring in a flexed position in which the print wire is retracted. When an electric current flows through the electromagnet for a print wire, it produces a magnetic field opposing the field generated by the permanent magnet, thereby releasing the spring. The print wire is thereby driven forward to print a dot.

When the current is removed from the electromagnet, the permanent magnet again attracts the armature, causing the print wire to return to its retracted position in preparation for printing the next dot.

There is a delay between the application of a voltage to the electromagnet (energization of the electromagnet) and the current flowing through the electromagnet because of the inductance in the electromagnet, and there is a delay between the current in the electromagnet and the movement of the print wire because of the inertia of the armature, and the like. If the time of energization is too short, the impact will be weak or absent, causing faint or skipped dots. If the energization time is too long, however, the print wire will be late in returning to its retracted position, then it will be necessary to lengthen the printing cycle. Otherwise the print wires will not be ready for the operation in the next printing cycle.

The optimum energization time depends on a plurality of factors, one of which is the voltage Vcc applied to the electromagnet. A prior-art scheme for controlling the energization time employs a resistor and capacitor connected in series between the power supply terminal Vcc and the ground, with the energization time regulated according to the charging time of the capacitor. This scheme automatically compensates for variations in the power supply voltage Vcc.

This prior-art timing scheme, however, fails to compensate for variations in characteristics of the electromagnets, and magnetic interference inside the print head. As a result, the energization time is not optimum, and the printing quality is not satisfactory. Moreover, to allow for such variations, it is necessary to add a margin to the energization time. Accordingly, on the average the electromagnet is energized for longer than the optimum time. As a result, the prior-art wire-dot print head driving apparatus is unnecessarily slow, consumes unnecessary current, and generates unnecessary heat.

SUMMARY OF THE INVENTION

An object of the present invention is to provide a driving apparatus for a wire-dot print head that solves the above-mentioned problems.

Another object of the invention is to optimize the timing of driving of the print wires.

Another object of the invention is to increase the operation speed of the print head.

A further object of the invention is to reduce the power consumption.

A further object of the invention is to improve the printing quality.

The driving apparatus according to the invention is for a wire-dot print head having electromagnets for driving print wires, each electromagnet comprising a core and a coil which is wound on the core, and comprises:

sensing coils provided in association with the respective electromagnets and provided to interlink the magnetic flux passing through the core of the associated electromagnet;

a magnetic flux detecting circuit connected to the sensing coils for detecting the magnetic flux passing through the core; and a control and drive circuit responsive to the detected magnetic flux for deciding the termination of the energization of the drive coil.

In the apparatus described above, the print wires are driven by the energization of the electromagnets. When the energization (application of a voltage from a power supply) is started, the current rises and the magnetic flux within the core changes. The magnetic flux in the core is affected by the magnetic interference from other electromagnets. When the magnetic flux becomes a certain value (this certain value is defined to be the value at which the print wire begins moving), the energization is terminated. Accordingly, despite the differences in the characteristics of the electromagnets and the effects of the magnetic interferences from other electromagnets, the energization is terminated at the optimum timings.

DETAILED DESCRIPTION OF THE PREFERRED EMBODIMENTS

Embodiments of this invention will be explained with reference to FIGS. 1 to 8.

Figure 1:
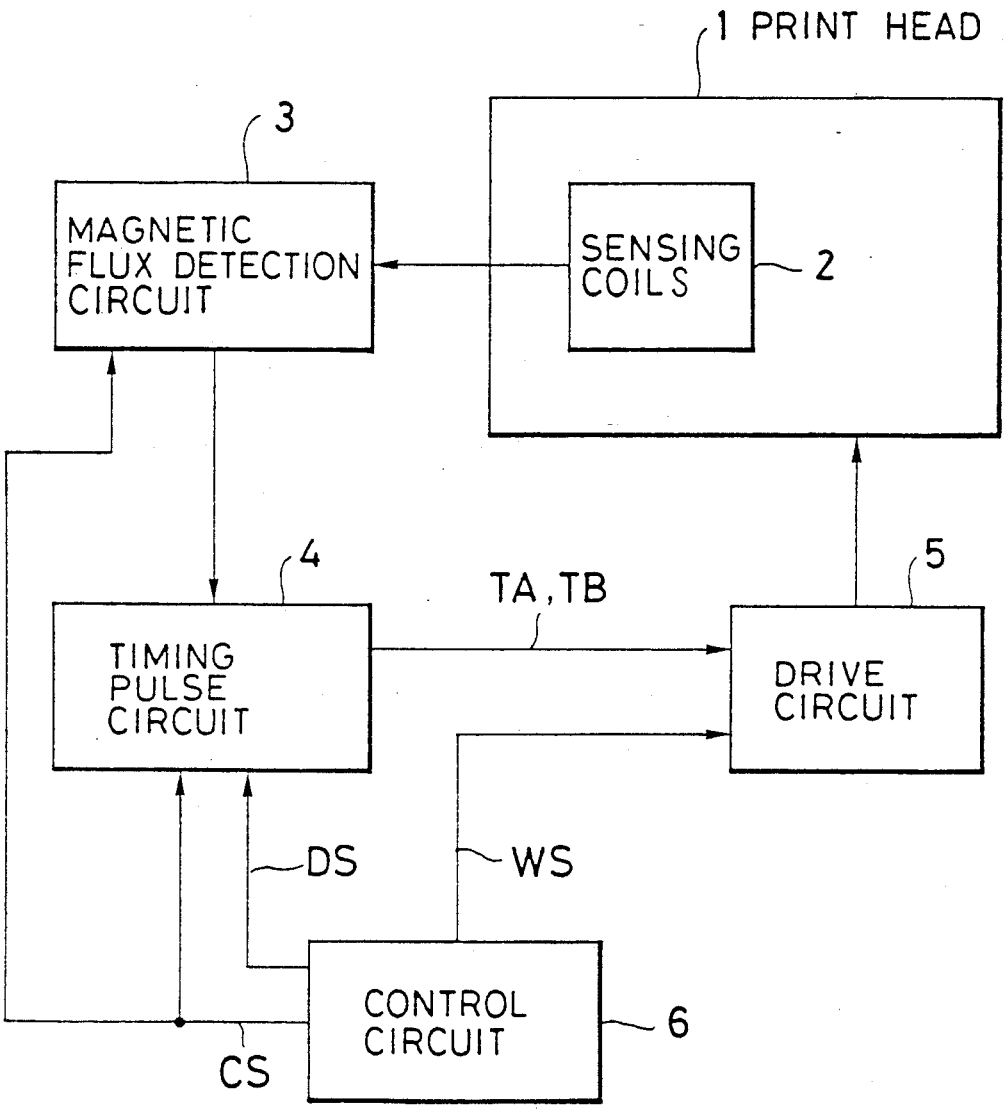
FIG. 1 is a block diagram illustrating a wire-dot print head driving apparatus according to an embodiment of the present invention.

FIG. 1 is a block diagram of an embodiment of a driving apparatus for a wire dot matrix print head according to this invention. As illustrated, this driving apparatus comprises a wire-dot print head 1 having sensing coils 2, a magnetic flux detection circuit 3, a timing pulse circuit 4, a drive circuit 5, and a control circuit 6.

The control circuit 6 exercises overall control of the wire-dot print head 1.

Figure 2:
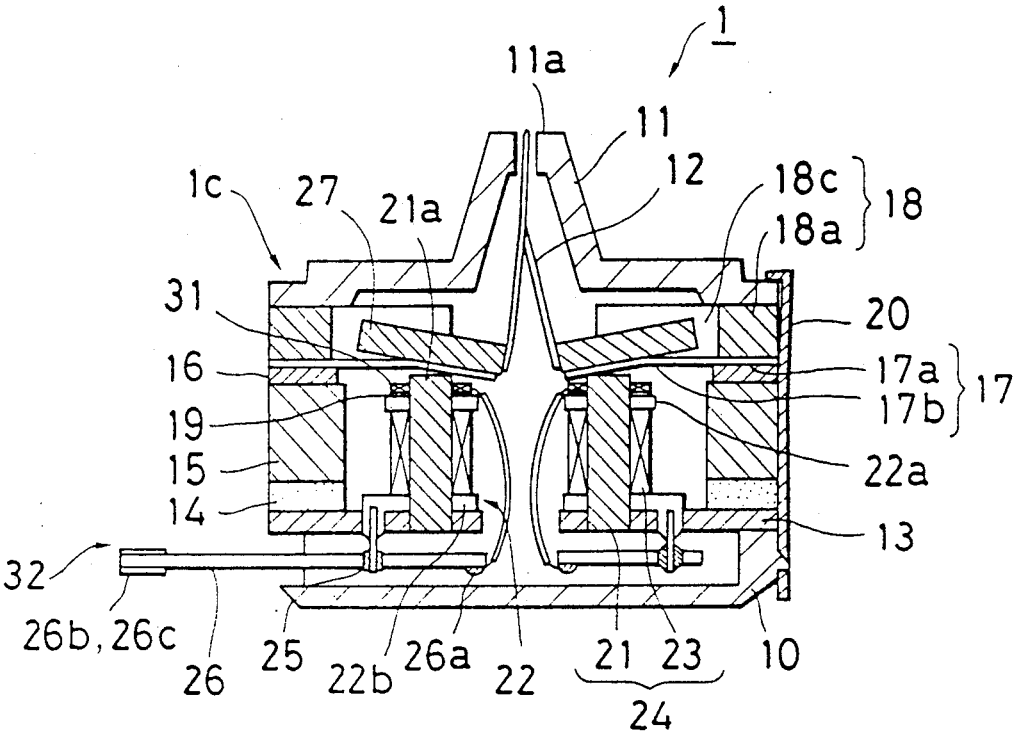
FIG. 2 is a sectional view of the print head in FIG. 1.
Figure 3A:
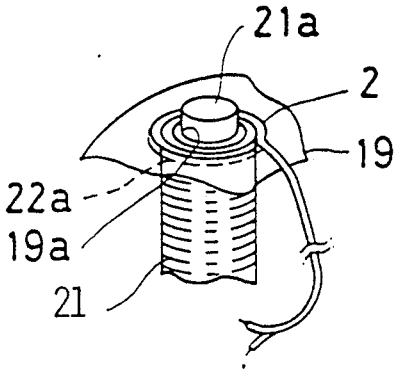
FIG. 3A is an oblique view showing a sensing coil.
Figure 3B:
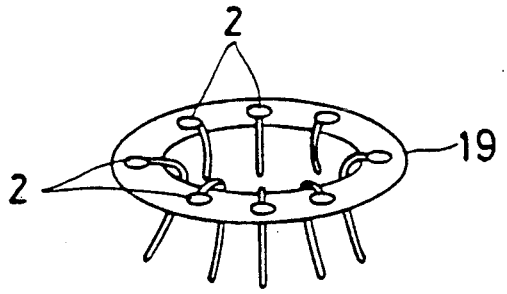
FIG. 3B is an oblique view showing a sensor card having sensing coils, the sensor card being shown to be removed from the head.
Figure 3C:
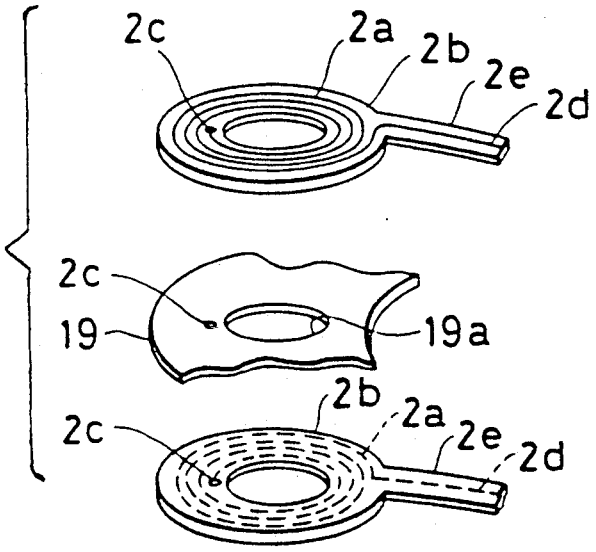
FIG. 3C is an exploded view of one sensing coil formed on the sensor card.
Figure 3D:
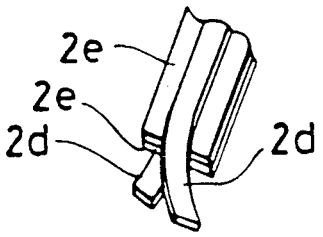
FIG. 3D is an enlarged oblique view showing ends of a pair of lead conductors connected to both ends of a sensing coil.
Figure 4:
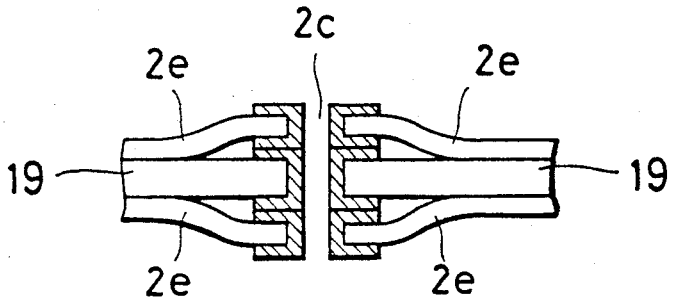
FIG. 4 is an enlarged sectional view of the part around the throughhole 2*c* in FIG. 3C.

FIG. 2 shows an embodiment of the wire-dot print head 1, which is generally cylindrical. The print head 1 has a generally disk-shaped cover 10 at the rear end (bottom in the figure) and a guide frame 11 at the front end (top in the figure). The guide frame 11 of this embodiment is formed of an electrically insulating material such as a plastic resin and has central guide openings 11*a* through which the print wires 12 protrude for impact on a printing medium such as a printing paper on a platen, not shown. The print wires 12 extend forward generally parallel with each other. For the purpose of explanation of the invention, "front" or "forward" refers to the direction toward which the print wires are moved for impact on the paper, i.e., upward as seen in FIG. 2.

Between the cover 10 and the guide frame 11 are mounted, in sequence from the rear side (bottom in FIG. 2) to the front side (top in FIG. 2), a generally disk-shaped base plate or rear yoke 13 of a magnetically permeable material, an annular permanent magnet 14, an annular upright support 15, an annular spacer 16, a plate spring 17, and a front yoke 18. The plate spring 17 has an annular part 17*a* and protrusions 17*b* extending radially inward. The front yoke 18 has an annular part 18*a*, and projections 18*c* extending inward from the inner surface of the annular part 18*a*. The annular part 18*a*, and the projections 18*c* are formed integrally.

The permanent magnet 14, the upright support 15, the spacer 16, the annular part 17*a* of the plate spring 17 and the annular part 18*a* of the front yoke 18 have generally the same outer and inner peripheries and form a cylindrical wall 1*c* of the print head 1. All these components are held together by an external clamp 20.

The annular part 17*a* of the plate spring 17 is clamped between the annular part 18*a* of the front yoke 18 and the spacer 15. Elongated armatures 27 extend in radial directions and attach to the respective protrusions 17*b* of the plate spring 17. Thus, each protrusion 17*b* of the plate spring 17 acts as a resilient support member for the associated armature 27. Each armature 27 is positioned between adjacent projections 18*c* of the front yoke 18. Conversely stated, there is one projection 18*c* of the front yoke 18 between adjacent armatures 27. The side surfaces of the armatures 27 and the side surfaces of the projections 18*c* are in close proximity with each other. The armatures 27 are provided in association with the respective print wires 12. A rear end of each print wire 12 is fixed to the inner end of the associated armature 27.

Cores 21 are provided in association with the respective armatures 27. Each core 21 has its forward end adjacent to the rear surface of the associated armature 27. The cores 21 are mounted on the rear yoke 13 so that their rear ends abut the rear yoke 13. Bobbins 22 having a front flange 22*a* and a rear flange 22*b* are provided to surround the respective cores 21 and are also mounted so that their rear flanges 22*b* abut the rear yoke 13. Coils 23 are wound on the respective bobbins 22 for the respective cores 21, to form electromagnets 24. Each coil 23 is electrically coupled via a coil terminal 25 to a printed circuit card 26 disposed between the rear yoke 13 and the cover 10.

The printed circuit card 26 is provided with a card-edge connector 32 having terminals 26*b*. Lead conductors formed of copper foils that have been patterned are provided on the printed circuit board 26, and connect the coil terminals 25 and the terminals 26*b* of the card edge connector 32. The terminals 26*b* of the card edge connector 32 are connected to the drive circuit 5 in FIG. 1.

The rear yoke 13, the cores 21, the armatures 27, the front yoke 18, the annular part 17*a* of the plate spring 17, the spacer 16, and the upright support 15 form a magnetic path for the magnetic flux from the permanent magnet 14. Because of this magnetic flux the armatures 27 are attracted to the cores 21.

As will be described in further detail later, when a current is made to flow through the coil 23, a magnetic flux which cancels the magnetic flux due to the permanent magnet 14 is generated in the core 21, and the armature 27 is released and moved forward by the action of the resilient support member 17*b*. The energization of each coil 23 is selectively made in accordance with the wire selection signal WS (WSl to WSn) from the control circuit 6.

An annular sensor card 19 in the form of a printed circuit film (printed circuit board made of a film) is positioned between the front flanges 22*a* of the bobbins 22 and the resilient support members 17*b*. The sensor card 19 has perforations 19*a* through which the front ends 21*a* of the cores 21 extend to project only slightly. The sensing coils 2 are provided on the front surface of the sensor card 19 in association with the respective cores 21. Each sensing coil 2 extends along a spiral line (see FIGS. 3*a* and 3*c*) to surround the front end 21*a* of the associated core 21 and thereby interlinks the magnetic flux passing through the core 21. The sensing coils 2 are in the form of a combination of sheet coils 2*a* on both surfaces of the sensor card 19, formed on respective insulator films 2*b*, and connected to each other via throughholes 2*c* in the insulator films 2*b* and the sensor card 19. Both ends of the sensing coil 2 are connected by respective lead conductors 2*d* which are formed on a strip-shaped insulator films 2*e*, and which run on the opposite surfaces of the sensor card 19, being superimposed with each other, and run off the inner periphery of the sensor card 19, being stacked with each other, and connected to the terminals 26*a* on the inner periphery of the printed circuit board 26. The parts of the lead conductors 2*d* which are disposed in the space inside the electromagnets are covered by synthetic resin filling this space.

The terminals 26*a* are connected via lead conductors on the printed circuit board 26 to terminals 26*c* of the card edge connector 32. These terminals 26*c* are connected to the magnetic flux detection circuit 3.

The advantage of each pair of lead conductors connected to both ends of each sensing coil 2 is that interlink of the lead conductors with any leakage magnetic flux is substantially eliminated, so that the detection of the magnetic flux by means of the sensing coil is not affected by any leakage magnetic flux around the sensing coil.

Figure 5:
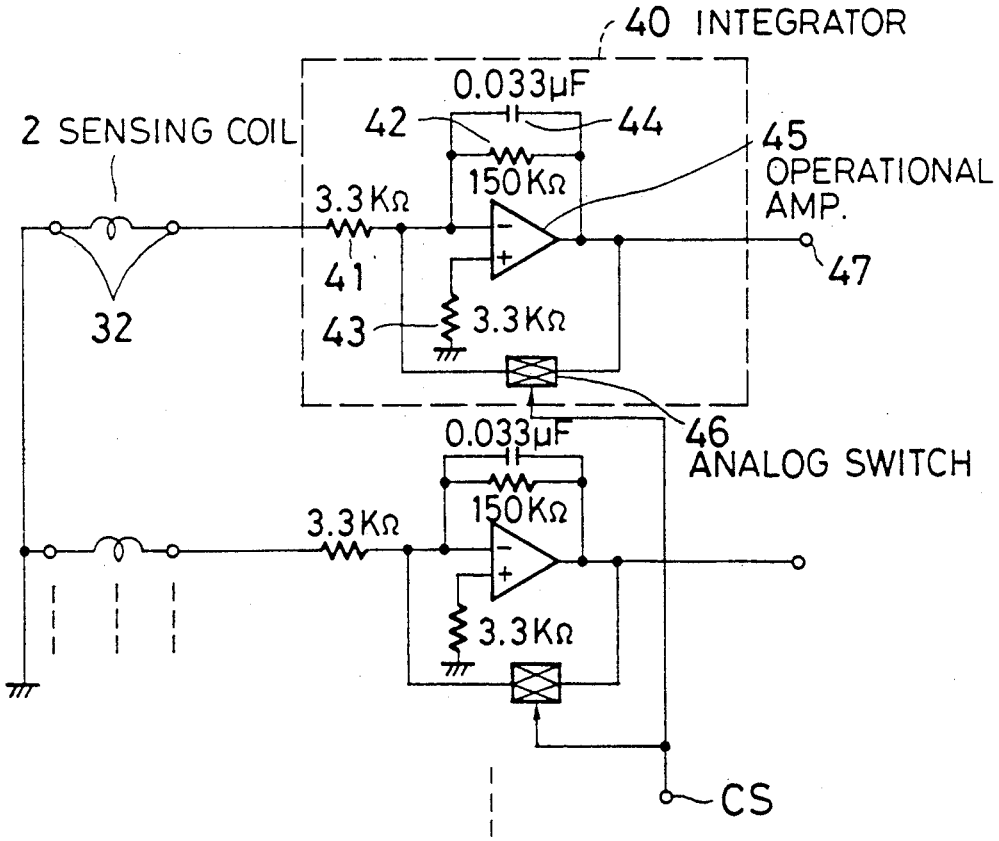
FIG. 5 is a schematic diagram of an embodiment of the magnetic flux detection circuit in FIG. 1.
Figure 8:
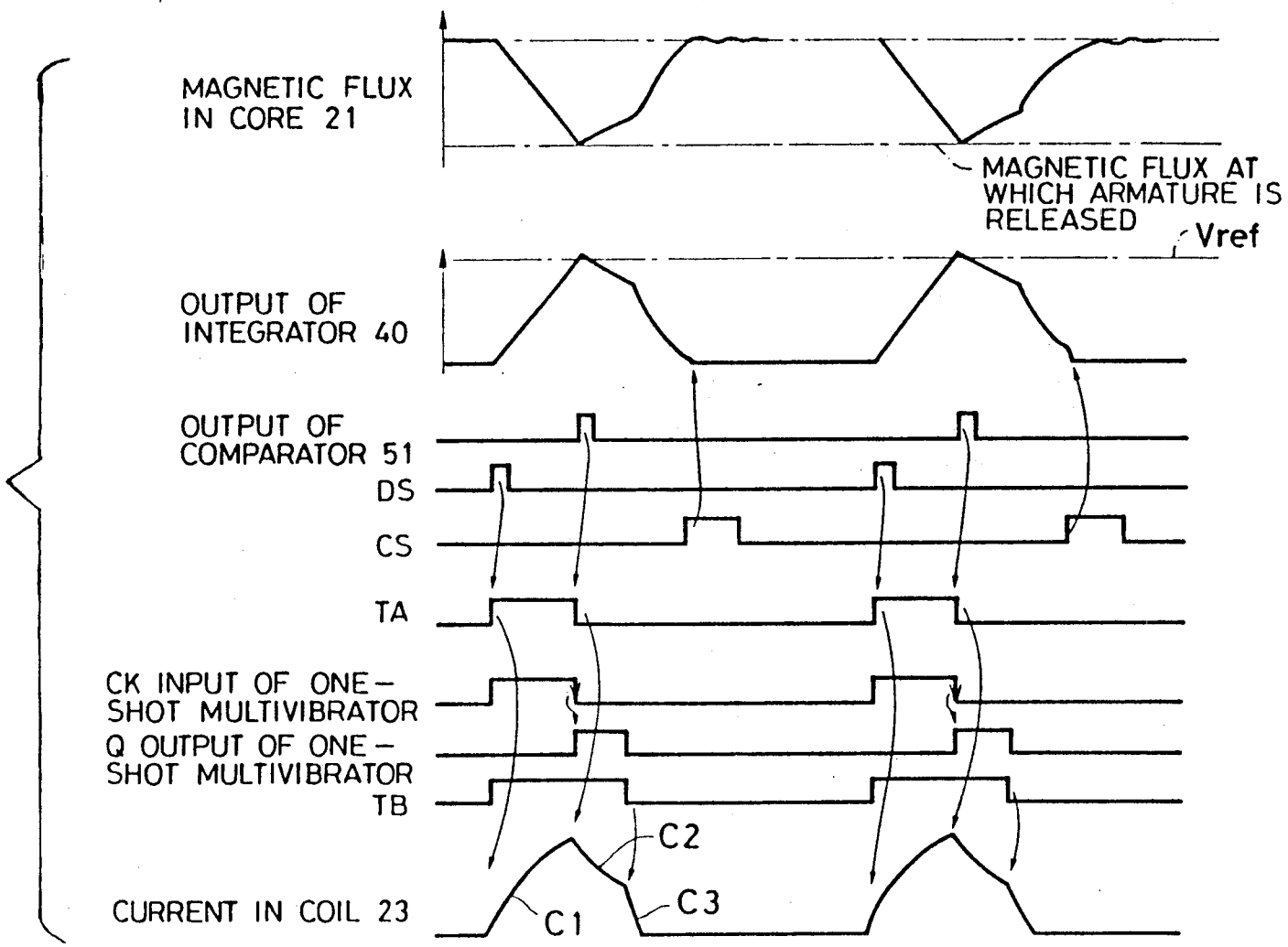
FIG. 8 illustrates signal waveforms at various points in FIGS. 5, 6 and 7.

FIG. 5 is a schematic diagram of an embodiment of the magnetic flux detection circuit 3. The magnetic flux detection circuit 3 comprises, for each sensing coil 2, an integrator 40 comprising resistors 41, 42 and 43, a capacitor 44 and an operational amplifier 45 connected as illustrated. The operational amplifier 45 receives the output of the sensing coil 2 at its negative input, so the integrator 40 produces an output voltage representing the time integration of the output voltage of the sensing coil 2 multiplied by "−1". The magnetic flux interlinking the sensing coil 2 and the output of the integrator 40 are illustrated in FIG. 8. As the output voltage of the sensing coil 2 is proportional to the time differential of the magnetic flux interlinking the sensing coil 2, the output of the integrator 40 on a node 47 is proportional to the magnetic flux interlinking the sensing coil 2. Thus, the magnetic flux detection circuit 3 produces a voltage signal representing the magnetic flux in the core 21 and supplies it to the timing pulse circuit 4.

An analog switch 46 is provided to be turned on by a clear signal CS which is supplied from the control circuit 6 periodically, i.e., at the interval of the printing cycle. When the analog switch 46 is turned on the integrator 40 is cleared so its output becomes zero. Thus, there will be no accumulation in the DC offset.

Figure 6:
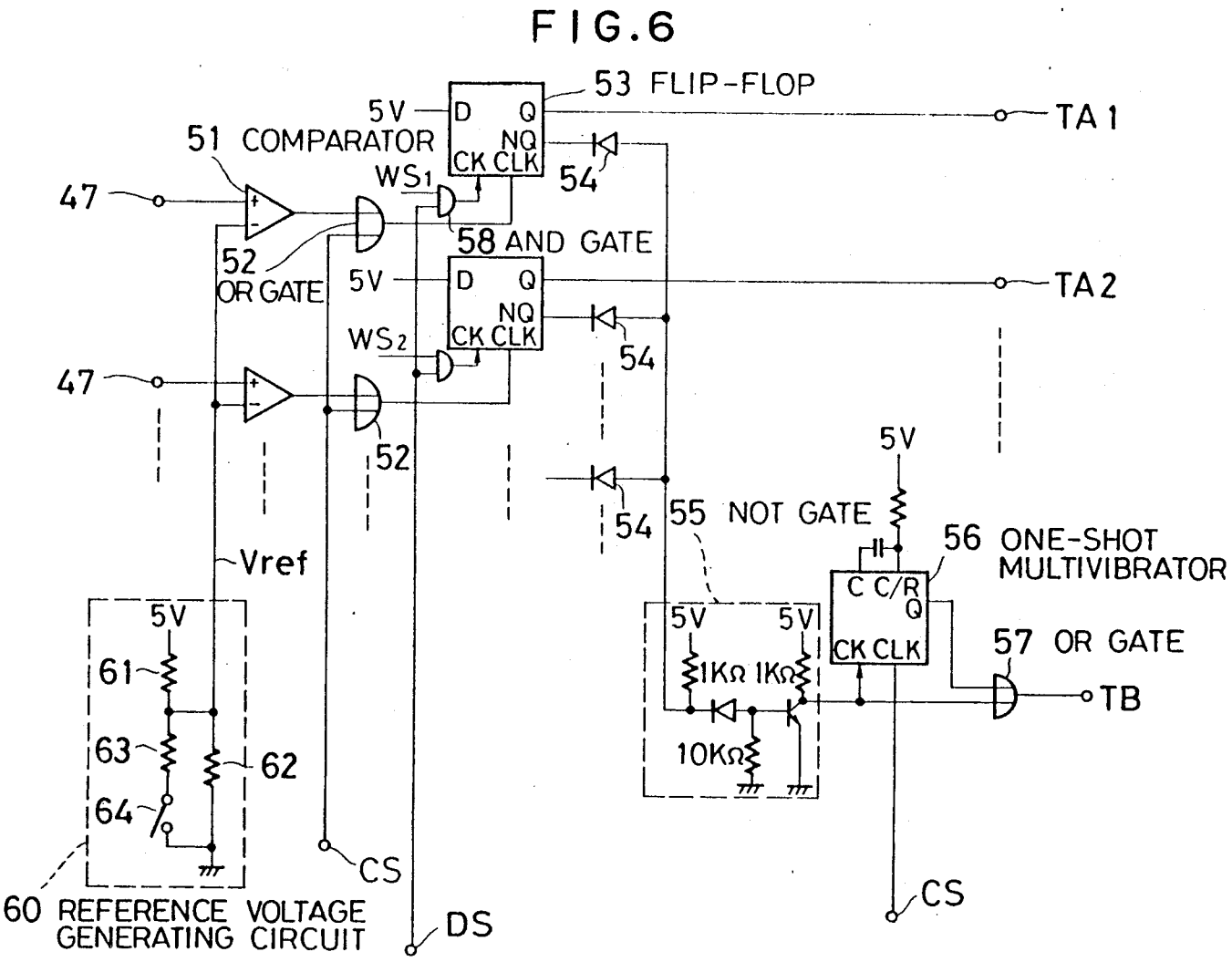
FIG. 6 is a schematic diagram of an embodiment of the timing pulse circuit in FIG. 1.

FIG. 6 is a schematic diagram of an embodiment of the timing pulse circuit 4. The timing pulse circuit 4 comprises. for each sensing coil 2, a comparator 51, an OR gate 52, and AND gate 58, a D-type flip-flop 53, and a diode 54. The Q outputs of the flip-flops 53 form the timing signals TA (TAl and TAn) for the respective print wires.

The timing pulse circuit 4 also comprises a NOT circuit 55, which also serves to provide a level-shift, and a one-shot multivibrator 56, and an OR gate 57. These are connected as illustrated, and provided in common for all the sensing coils 2. The diodes 54 and the NOT circuit 55 in combination form a wired-NOR gate of the negative logic (i.e., a NAND gate) whose output is High when at least one of the NQ outputs of the flip-flops 53 is Low.

The one-shot multivibrator 58 is triggered by a falling edge of its CK input and produces a pulse of a predetermined duration. The CK input and the Q output of the one-shot multivibrator 56 are ORed at the OR gate 57, whose output forms the timing signal TB of the timing pulse circuit 4.

The AND gates 58 receive the wire selection signals WS (WSl to WSn) for the respective print wires, and the drive start signal DS from the control circuit 6. The wire selection signals WS are High when the associated print wires are to be actuated for printing a dot on the printing paper. The outputs of the AND gates 58 are supplied to the clock input terminals CK of the respective flip-flops 53. Then, these flip-flops 53 are set, and their Q outputs go High, and the NQ outputs go Low. Accordingly, the input of the OR gate 57 that is connected to the CK input of the one-shot multivibrator 56 goes High.

Each comparator 51 compares the output of the corresponding integrator 40 with a reference voltage Vref supplied from a reference voltage generating circuit 60, comprising resistors 61, 62 and 63 and a switch 64 which are connected as illustrated. The reference voltage Vref is so determined as to be about equal to the voltage on the node 47 when the detected magnetic flux becomes so low that the armature is released and starts moving forward.

The switch 64 is closed or opened manually depending on the head gap. For instance, when the head gap is wide, the switch 64 is opened so that the reference voltage Vref becomes larger.

The reference voltage generating circuit 60 is shown to be provided in common for all the sensing coils 2, and hence for all the print wires. But it may alternatively be so arranged that each print wire has its own reference voltage generating circuit 60.

The output of the comparator 51 is supplied through the associated OR gate 52 to a clear terminal CLR of the associated flip-flop 53.

When the flip-flop 53 is reset its Q output goes Low and the NQ output of the flip-flop 53 goes High. When the NQ outputs of all the flip-flops 53 become High, the CK input to the one-shot multivibrator 56 falls, so the one-shot multivibrator 56 produces a pulse at its Q output. Since the timing signal TB of the timing pulse circuit 4 is the logical OR of the CK input and the Q output of the one-shot multivibrator 56, it rises when the drive start signal DS rises and falls upon expiration of a predetermined duration from the resetting of all of the flip-flops 53 (i.e., from the resetting of the last one of the flip-flops 53).

The clear signal CS is also supplied to the flip-flops 53 to reset the flip-flops 53 in of which the resetting by the output of the comparators 51 has failed in error. The clear signal CS is also supplied to the one-shot multivibrator 56 in case the one-shot multivibrator 56 is erroneously triggered at undesirable timing.

Figure 7:
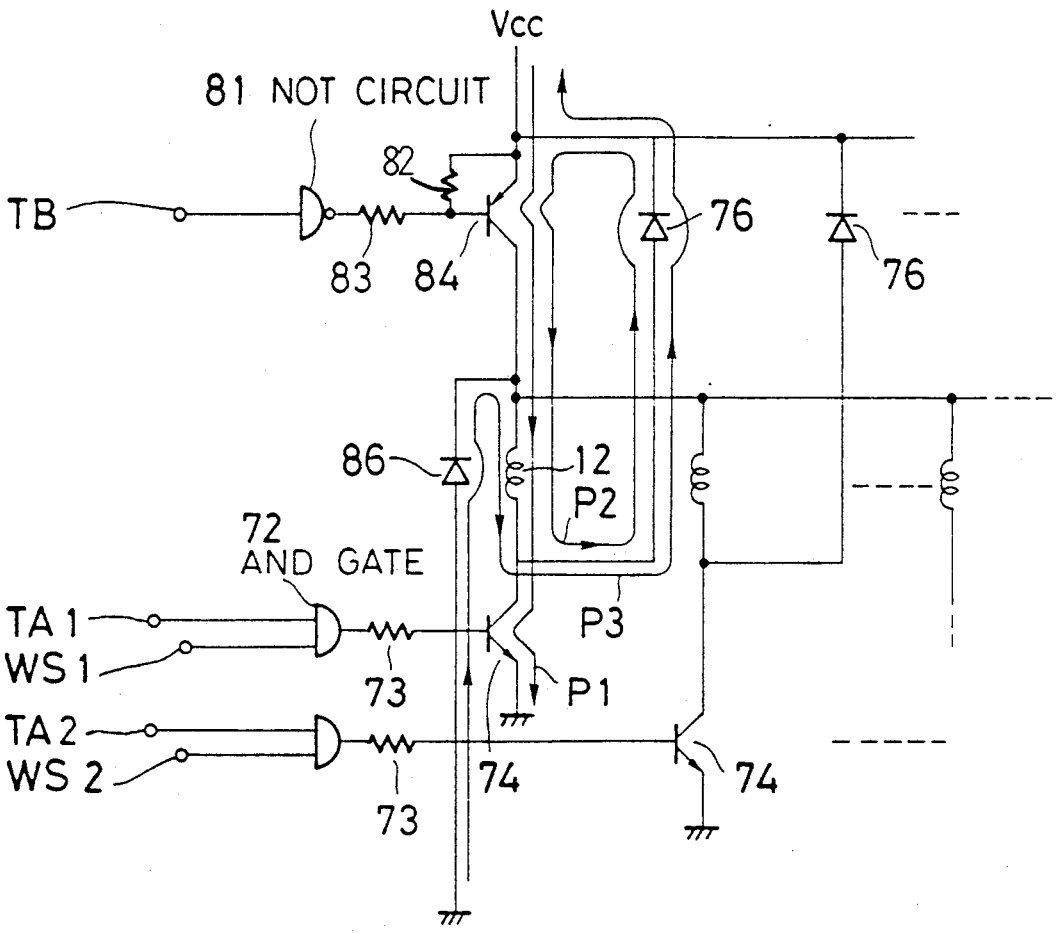
FIG. 7 is a schematic diagram of an embodiment of the drive circuit in FIG. 1.

FIG. 7 shows an example of drive circuit 5 and coils 23 of the electromagnets associated with the respective print wires. The coil 23 of the electromagnets 24 will hereinbelow be called drive coils to distinguish from the sensing coils 2. Each drive coil 23 is associated with an AND gate 72, a resistor 73, an NPN transistor 74 and a diode 76 connected as illustrated.

Each AND gate 72 receives the timing signal TA (one of TAl to TAn) for the associated print wire and a wire selection signal WS for the associated print wire. The output of the AND gate 72 is applied through the resistor 73 to the base of the transistor 74 which is turned on when its base input is High.

The interconnection of the drive coils 23, the AND gate 72, the resistor 73, the transistor 74, and the diode 76 is illustrated in detail only in connection with one of the print wires.

The timing signals TA (TAl to TAn) are generated on condition that the logical products at the corresponding AND gates 58 in the timing pulse circuit 4 are "H". Accordingly, the AND gate 72 in the drive circuit 52 may be omitted, and the timing signals TA (TAl to TAn) may be directly applied to the bases of the transistors 74. In this embodiment, the AND gates 72 are inserted to avoid erroneous operations.

The drive circuit 5 further comprises a NOT circuit 81, resistors 82 and 83, a PNP transistor 84 and a diode 86 provided in common for all the print wires. The NOT circuit 81 receives the timing signal TB from the timing pulse circuit 4. The output of the NOT circuit 8 is applied through the resistor 83 to the base of the transistor 84, which is turned on when the input to the base is Low, i.e., when the timing signal TB is High.

When both of the transistors 84 and 74 are on, an electric current flows through a path P1, from the power supply Vcc, through the transistor 84, the drive coil 23, and the transistor 74, and to the ground.

When the transistor 84 is on and the transistor 74 is off, and if the drive coil 23 generates an electromotive force in the downward direction as seen in FIG. 7, an electric current flows along a path P2, through the drive coil 23, the diode 76 and the transistor 84.

When the transistors 84 and 74 are both off, and if the drive coil 23 generates an electromotive force in the downward direction as seen in FIG. 7, an electric current flows along a path P3, from the ground, through the diode 86, the coil 23, and the diode 76, and to the power supply terminal Vcc.

Next the operation of the overall apparatus is described with reference to FIG. 8.

The drive start signal DS and the clear signal CS are periodically generated, once each printing cycle. The print wires to be actuated in each print cycle are designated by the wire selection signals WS (WSl to WSn). The wire selection signals WS (WSl to WSn) and the drive start signal DS and ANDed at the AND gates 58, and the outputs of the AND gates 58 set the corresponding flip-flops 53. As a result, the corresponding flip-flops 53 are set, so the corresponding timing signals TA (TAl to TAn) rise. The timing signals TA pass through the corresponding AND gates 72 (which are opened by the corresponding wire selection signals WS) and applied to the corresponding transistors 74. The transistors 74 selected by the wire selection signals are therefore turned on.

The timing signal TB rises simultaneously with the timing signals TA, and the transistor 84 is turned on. Accordingly, the drive coils 23 of the electromagnets to be actuated, i.e., selected by the wire selection signals, are energized by current flowing along the path P1 (FIG. 7). The current changes as illustrated in FIG. 7. That is, the current rises as indicated by Cl in FIG. 8. Accordingly, the drive coils 23 of the electromagnets 24 selected by the wire selection signals WS are energized by currents flowing along the paths P1. The magnetic fluxes in the cores change with the respective currents. As the current increases, the magnetic flux within the core (the magnetic flux due to the permanent magnet) is canceled and is thereby reduced. As the magnetic flux in each core becomes sufficiently small so that the armature is released and the print wire starts moving forward, the timing signals TA falls, this is detected by the magnetic flux detection circuit 3, and the corresponding timing signal TA falls, and the energization of the electromagnet is terminated. That is, the transistor 74 is turned off while the transistor 84 is kept on. As a result, the current continues to flow through the coil, along the path P2 (FIG. 7) because of the electromotive force induced in the coil.

This current gradually decreases as indicated by C2 in FIG. 8, due mainly to the resistance in the coil 23. When the timing signal TB from timing pulse circuit 4 goes Low, the transistor 84 turns off, interrupting the path P2. After that, the current flows through the path P3, back to the power supply. This current rapidly diminishes as indicated by C3 in FIG. 8.

In this way, the timing at which energization of each electromagnet is terminated is decided responsive to the magnetic flux. Although the magnetic flux in each core is also affected by the magnetic interference within the head, i.e., from other electromagnets, as the sensing coil is sensitive to the net magnetic flux which determines the moment of onset of motion of the print wire, the timing at which the energization of each coil is optimized, taking account of any magnetic interference.

The timing at which the timing signal TA falls may differ from one print wire to another, since there can be variations in the characteristics of the coils, and the effect of magnetic interference can differ from one coil to another. When all the timing signals TA fall, the one-shot multivibrator produces a pulse of a predetermined duration. Upon expiration of the predetermined duration, the timing signal TB falls, so that the path P2 is interrupted.

The duration of the pulse of the one-shot multivibrator is so set that the time at which the timing signal TB falls is about the same as the time at which the print wires impact the printing paper.

After these operations are effected (and within the particular print cycle) the control circuit 6 produces a clear signal CS. The clear signal CS is delivered to the integrators 40 to clear their outputs, to the flip-flops 53 to reset them (those which have not been reset by the comparator output because the magnetic flux did not change, and those which have not been reset in error), and to the one-shot multivibrator 58 in case it should have been triggered in error.

This completes one cycle of operation, and the elements are now ready for operation in the next print cycle.

Figure 9:
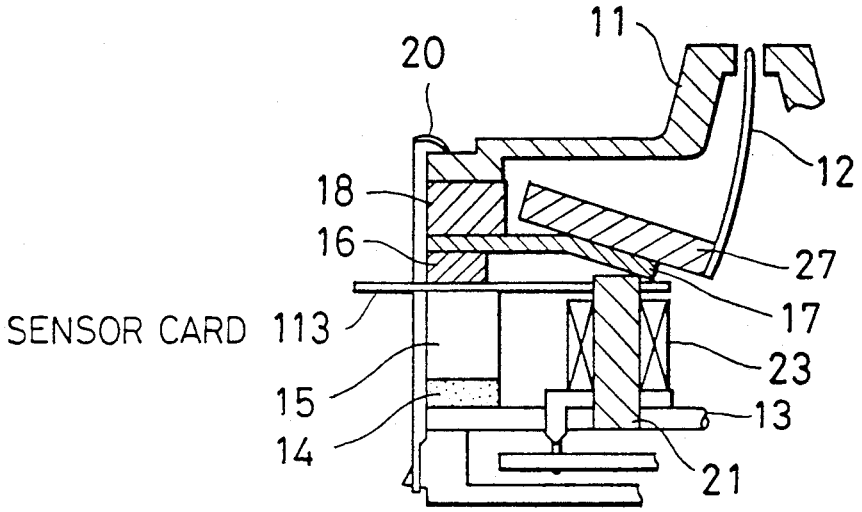
FIG. 9 is a sectional view showing another embodiment of the print head according to the invention.
Figure 10:
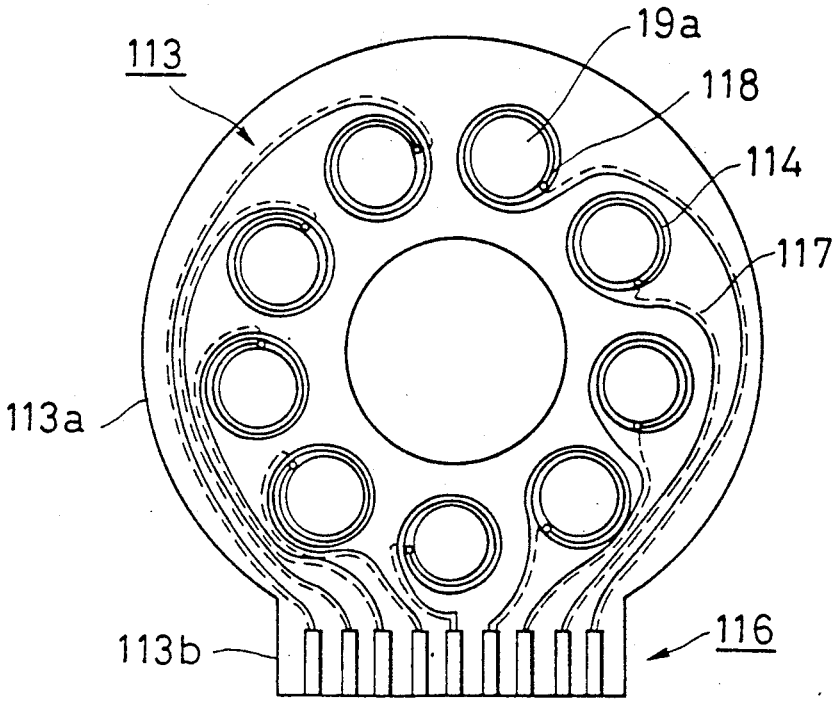
FIG. 10 is a plan view of a sensor card used in the embodiment of FIG. 9.

FIG. 9 and FIG. 10 shows another embodiment of a print head according to the invention.

This embodiment differs from the embodiment of FIG. 2 in the configuration of the sensor card. That is the sensor card 113 of this embodiment is similar to the embodiment of FIG. 2 in that it is generally annular, but its radially outer part is interposed between the upright support 15 and the spacer 16. In other words, this part penetrates the cylindrical wall 1*c* of the print head 1. Its outer periphery 113*a* is substantially coincident with the outer periphery of the cylindrical wall 1*c*. The outer periphery 113*a* is provided with a part 113*b* protruding outward. This protruding part 113*b* is provided with a card edge connector 116. Both ends of the sensing coils 114 (which themselves are identical to the sensing coils 2) are connected via lead conductors 117 on the sensor card 113 to the card edge connector 116. The card edge connector 116 is connected to the magnetic flux detection circuit 3.

As was explained in connection with the embodiment of FIG. 2, the lead conductors 117 connected to both ends of each sensing coil 114 extend on the opposite surfaces of the sensor card 113, being superimposed with each. This is to minimize the effect of the leakage magnetic flux. Contrary to the embodiment of FIG. 2, no lead conductors need be provided on the printed circuit board 26 for the connection of the sensing coils 114, and no wiring conductors (like those 19) for connecting the sensor card 113 and the printed circuit board 26 are required.

The scope of this invention is not restricted to the embodiments described above. In particular, it is not necessary for the print head to have the spring-release structure illustrated in FIG. 2; it can have any structure that has an electromagnet including a core, with the magnetic flux in the core varying to become a certain level when the print wire starts moving toward the printing paper. For example, the invention is also applicable to the print head of the clapper-type having electromagnets which attract armatures when moving the print wires toward the printing paper.

As has been described, according to the invention, the magnetic fluxes are detected by the use of the sensing coils and the magnetic flux detection circuit, and the timings at which the energization of the electromagnets are terminated are determined on the basis of the result of the detection. Accordingly, the timings of the termination of the energization are optimized, so the printing quality is improved. Moreover, printing speed is increased, power consumption is reduced, and rise of temperature in the print head is reduced.

What is claimed is:

1. A driving apparatus for a wire-dot print head having electromagnets for inducing an electromotive force and driving print wires, each electromagnet comprising a core having front and rear ends, and a drive coil wound on the core, the front end of said core projecting from said drive coil:

said apparatus comprising:

sensing coils disposed about the core front ends of respective electromagnets, each of said sensing coils interlinking magnetic flux generated within the print head, and passing through the front end of the core of the associated electromagnet;

a magnetic flux detecting circuit connected to the sensing coils for detecting the magnetic flux passing through the front end of said core; and a control and drive circuit means, responsive to the detected magnetic flux, for terminating energization of the drive coil at a predetermined time, wherein said print head further comprises print head wires extending generally parallel with each other in a forward direction, armatures in association with the respective print wires, a rear end of each print wire being fixed to a front surface of the associated armature, said cores of the electromagnets having their front ends positioned adjacent rear surfaces of the associated armatures, and a printed circuit card having perforations, with respective cores of the electromagnets having their front ends extending through respective perforations in the printed circuit card; and the sensing coils are disposed on the printed circuit card and extend to surround the perforations.

2. The apparatus of claim 1, wherein the print head further comprises a permanent magnet inducing magnetic flux in the cores of the electromagnets;

the magnetic flux within the print head includes the magnetic flux generated by the electromotive force of the electromagnets and the magnetic flux induced by the permanent magnet in the cores, the electromagnet magnetic flux cancelling the permanent magnet magnetic flux forming a net magnetic flux; and said control and drive circuit means terminates the energization of the coil when the net magnetic flux in the associated core becomes smaller than a predetermined threshold value.

3. The apparatus of claim 1, wherein said print head further comprises resilient support means for biasing the armatures forward; and said print wire is retracted by being attracted to the front end of the core of the associated electromagnet, with the resilient means being resiliently deformed, when the electromagnet is not energized.

4. The apparatus of claim 1, wherein each of said sensing coils extends along a spiral line surrounding the front end of the associated core.

5. A driving apparatus for a wire-dot print head having electromagnets for driving print wires and inducing an electromotive force, each electromagnet comprising a core having front and rear ends and a drive coil mounted on the core, the front end of the core projecting from said drive coil, said apparatus comprising:

sensing coils disposed about the core front ends of respective electromagnets, each of said sensing coils interlinking magnetic flux generated within the print head and passing through the front end of the core of the associated electromagnet;

a magnetic flux detecting circuit connected to the sensing coils for detecting the magnetic flux passing through the front end of the core; and control and drive circuit means, responsive to the detected magnetic flux, for terminating the energization of the drive coil at a predetermined time, said control and drive circuit means comprising a control circuit for generating a print signal, a timing circuit for generating an onset detection signal indicating the onset of motion of said print wires, and a drive circuit including a first current path means for connecting the drive coil of the electromagnet across a pair of power supply terminals of a power supply to permit flow of electric current from said power supply to the drive coil, a second current path means for permitting and electric current due to any electromotive force induced in the drive coil to flow therethrough, and current path control means for causing an electric current to flow through said first current path means to energize said drive coil upon reception of said print signal, and responding to said timing circuit for terminating the current flow through said first current path means and initiating the current flow through said second current path means upon reception of said onset detection signal; wherein said print head further comprises print wires extending generally parallel with each other in a forward direction, armatures in association with the respective print wires, a rear end of each print wire being fixed to a front surface of the associated armature, said cores of the electromagnets having their front ends positioned adjacent rear surfaces of the associated armatures, and a printed circuit card having perforations with respective cores of the electromagnets having their front ends extending through respective perforations in the printed circuit card; and the sensing coils are disposed on the printed circuit card and extend to surround the perforations.

6. The apparatus of claim 2, wherein the print head further comprises a permanent magnet inducing magnetic flux in the cores of the electromagnets;

the magnetic flux within the print head includes the magnetic flux generated by the electromotive force of the electromagnets and the magnetic flux generated by the permanent magnet in the cores, the electromagnet magnetic flux cancelling the permanent magnet magnetic flux and forming a net magnetic flux in the cores; and said control and drive circuit terminates the energization of the drive coil when the net magnetic flux in the associated core becomes smaller than a predetermined threshold value.

7. The apparatus of claim 5, wherein said print head further comprises resilient support means for biasing the armatures forward; and said print wire is retracted by being attracted to the front end of the core of the associated electromagnet, with the resilient means being resiliently deformed, when the electromagnet is not energized.

8. The apparatus of claim 5, wherein each of said sensing coils extends along a spiral line surrounding the front end of the associated core.

9. A wire-dot print head comprising:

print wires extending forward generally parallel with each other;

armatures in association with the respective print wires, a rear end of each print wire being fixed to a front surface of the associated armature;

cores provided in association with the respective armatures, each core having its front end adjacent to a rear surface of the associated armature;

drive coils in association with the respective cores, each drive coil being wound on the associated core, the front end of each core projecting from its associated drive coil;

a cylindrical wall surrounding said armatures, said cores and said drive coils;

resilient support members in association with the respective armatures, each resilient support member having a first end fixed at said cylindrical wall and a second end fixed to the associated armature;

sensing coils disposed about the core front ends of respective electromagnets, each of said sensing coils interlinking magnetic flux within the print head and passing through the front end of the core of the associated electromagnet; and a printed circuit card having perforations provided in association with the respective cores; wherein the cores of the electromagnets have their front ends extending through the associated perforations in the printed circuit card; and the sensing coils are disposed on the printed circuit card and extend to surround the perforations.

10. The apparatus of claim 9, wherein each of said sensing coils extends along a spiral line surrounding the front end of the associated core.

11. The print head of claim 9, wherein said printed circuit card has a part penetrating said cylindrical wall and having an edge at which card edge connector is formed, said sensing coils being connected via lead conductors formed on said printed circuit card to the card edge connector.

12. The print head of claim 11, wherein a pair of the leads connected to both ends of one of said sensing coils are formed on opposite faces of the printed circuit card, superimposed with each other.

13. A wire-dot print head comprising:

print wires extending forward generally parallel with each other;

armatures in association with the respective print wires, a rear end of each print wire being fixed to a front surface of the associated armature;

a substantially disk-shaped yoke;

cores mounted at their rear ends on said rear yoke in association with the respective armatures, each core having its front end adjacent to rear surface of the associated armature;

drive coils in association with the respective cores, each drive coil being wound on the associated core, the front end of each core projecting from its associated drive coil;

a cylindrical wall surrounding said armatures, said cores and said drive coils;

an annular permanent magnet forming part of said cylindrical wall;

resilient support members in association with the respective armatures, each resilient support member having a first end fixed at said cylindrical wall and a second end fixed to the associated armature;

a front yoke having protrusions positioned on a side of the armatures;

magnetic path means for allowing a magnetic flux from said permanent magnet to pass through said core, said armature and said front yoke;

sensing coils disposed about the core front ends of respective electromagnets, each of said sensing coils interlinking magnetic flux generated by said permanent magnet and the electromagnets and passing through the front end of the core of the associated electromagnet; and a printed circuit card having perforations provided in association with the respective cores, wherein the cores of the electromagnets have their front ends extending through the associated perforations in the printed circuit card, and the sensing coils are disposed on the printed circuit card and extend to surround the perforations; and wherein when each of the drive coils is not energized the associated armature is attracted toward the associated core due to the net magnetic flux in the core which essentially consists of the magnetic flux from the permanent magnet, thereby to resiliently deform the associated resilient support member; and when each of the drive coils is energized the magnetic flux form the electromagnet coil cancels the magnetic flux from the permanent magnet thereby to reduce the net magnet flux passing through the core and interlinking with the sensing coil, the associated armature is released and moved forward by the action of the associated resilient support member.

14. The apparatus of claim 13, wherein each of said sensing coils extends along a spiral line surrounding the front end of the associated core.

* * * * *